US007380516B1

(12) United States Patent
Camilleri

(10) Patent No.: US 7,380,516 B1
(45) Date of Patent: Jun. 3, 2008

(54) ROTATING DAVIT APPARATUS

(76) Inventor: Anthony G. Camilleri, 105 Wigmore Dr., Toronto (CA) M4A 2G1

( * ) Notice: Subject to any disclaimer, the term of this patent is extended or adjusted under 35 U.S.C. 154(b) by 0 days.

(21) Appl. No.: 11/828,670

(22) Filed: Jul. 26, 2007

(51) Int. Cl.
*B63B 1/24* (2006.01)

(52) U.S. Cl. ..... 114/374

(58) Field of Classification Search ..... 114/368–374, 114/44; 405/3; 414/543, 678; 212/223, 212/306, 307, 245, 249
See application file for complete search history.

(56) References Cited

U.S. PATENT DOCUMENTS 1,614,316 A * 1/1927 Petersen ..... 114/374
2,045,587 A * 6/1936 Dean ..... 114/374
2,465,118 A * 3/1949 Platt ..... 414/678
2,486,094 A * 10/1949 Andrade ..... 114/370
3,804,263 A 4/1974 Castonguay
3,854,594 A 12/1974 Brooks
4,951,594 A * 8/1990 Feikema ..... 114/361

* cited by examiner

*Primary Examiner*—Ed Swinehart

(57) ABSTRACT

The rotating davit apparatus is for fit next to a boat arch. The apparatus is also provided with a modified arch, as desired by the customer. The apparatus is designed to blend into the shape of boat arches, and is thus provided in a plurality of sizes and lift arm angle variations. The apparatus can be used singularly or in pairs, triplet, or as a quad installation wherein 4 apparatuses are mated to the arch. The apparatus provides utility as well as aesthetic appeal. The basic design provides for relatively inexpensive production and sale.

16 Claims, 9 Drawing Sheets

ROTATING DAVIT APPARATUS

BACKGROUND OF THE INVENTION

A davit is a crane which projects over the side of a ship and is used especially for lifting boats, anchors, and other such objects. A davit can be a convenience or often a necessity in lifting a dinghy or personal watercraft in and out of a boat. Davits must be designed with sufficient structural integrity to withstand the loads for which they are intended. Typically, then, a davit is at best awkward in appearance. Davits also usually occupy space that could otherwise be used in alternate ways. Most modern boats are extremely concerned with appearance and space utilization. Consequently, typical davits are complex, multi-jointed, hinged devices which attempt to conserve space. What is needed is a basic davit that is not readily apparent to the eye, but can be pivoted and used effectively, then stowed in a manner which does not detract from a boat's appearance or available space. The present apparatus provides these advantages.

FIELD OF THE INVENTION

The rotating davit apparatus relates to davit systems and more especially to a rotating davit with a one-piece lift arm which blends with a boat arch.

SUMMARY OF THE INVENTION

The general purpose of the rotating davit apparatus, described subsequently in greater detail, is to provide a rotating davit apparatus which has many novel features that result in an improved rotating davit apparatus which is not anticipated, rendered obvious, suggested, or even implied by prior art, either alone or in combination thereof.

To attain this, the rotating davit apparatus provides for fit next to an existing boat arch. The apparatus is also provided with a modified arch, as desired by the customer. The apparatus is designed to blend into the shape of boat arches, and is thus provided in a plurality of sizes and lift arm angle variations. The apparatus can be used singularly or in pairs, triplet, or as a quad installation wherein 4 apparatuses are mated to the arch. The apparatus provides utility as well as aesthetic appeal. The basic design provides for relatively inexpensive production and sale.

Thus has been broadly outlined the more important features of the improved rotating davit apparatus so that the detailed description thereof that follows may be better understood and in order that the present contribution to the art may be better appreciated.

An object of the rotating davit apparatus is to provide rotational capability.

Another object of the rotating davit apparatus is to fit congruently with an arch of a boat.

A further object of the rotating davit apparatus is to provide at least 180 degrees of pivot for each apparatus.

An added object of the rotating davit apparatus is to conceal the pulleys and part of the cable of the apparatus.

And, an object of the rotating davit apparatus is to provide an aesthetically pleasing davit which is visually unobtrusive.

Yet another object of the rotating davit apparatus is to be basic.

Another object of the rotating davit apparatus is to be aerodynamic.

These together with additional objects, features and advantages of the improved rotating davit apparatus will be readily apparent to those of ordinary skill in the art upon reading the following detailed description of presently preferred, but nonetheless illustrative, embodiments of the improved rotating davit apparatus when taken in conjunction with the accompanying drawings.

In this respect, before explaining the current embodiments of the improved rotating davit apparatus in detail, it is to be understood that the rotating davit apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved rotating davit apparatus. It is therefore important that the claims be regarded as including such equivalent constructions insofar as they do not depart from the spirit and scope of the rotating davit apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 11 thereof, the principles and concepts of the rotating davit apparatus generally designated by the reference number 10 will be described.

Figure 1:
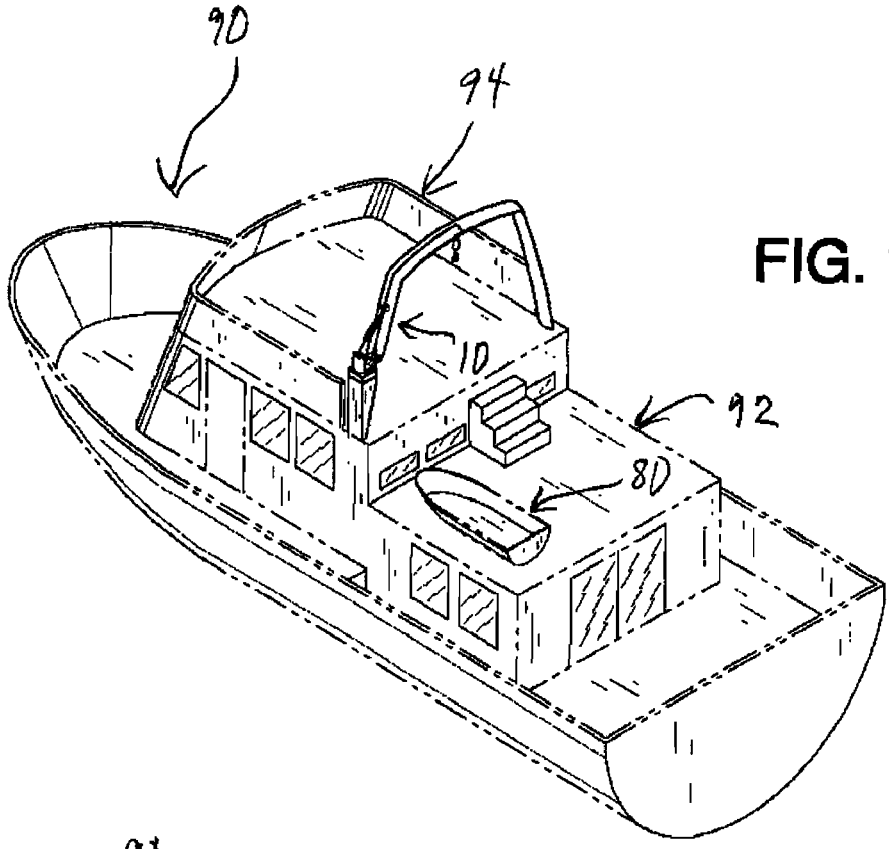
FIG. 1 is a perspective view of a boat fitted with one of the apparatus.
Figure 2:
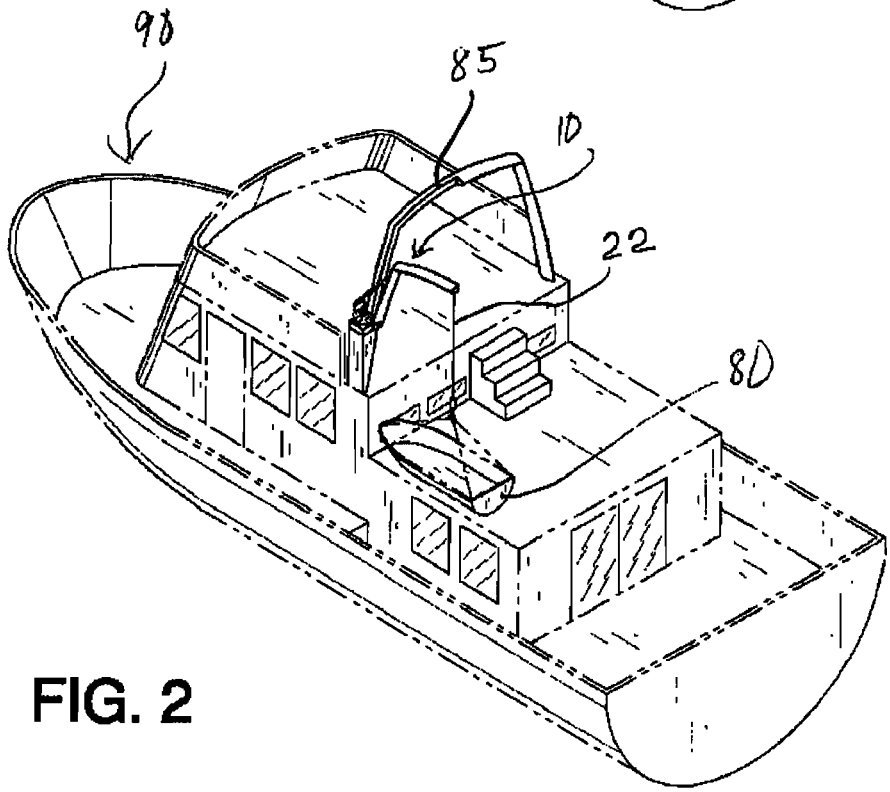
FIG. 2 is a perspective view of a boat fitted with the apparatus in use, the dinghy on the deck of the boat.
Figure 3:
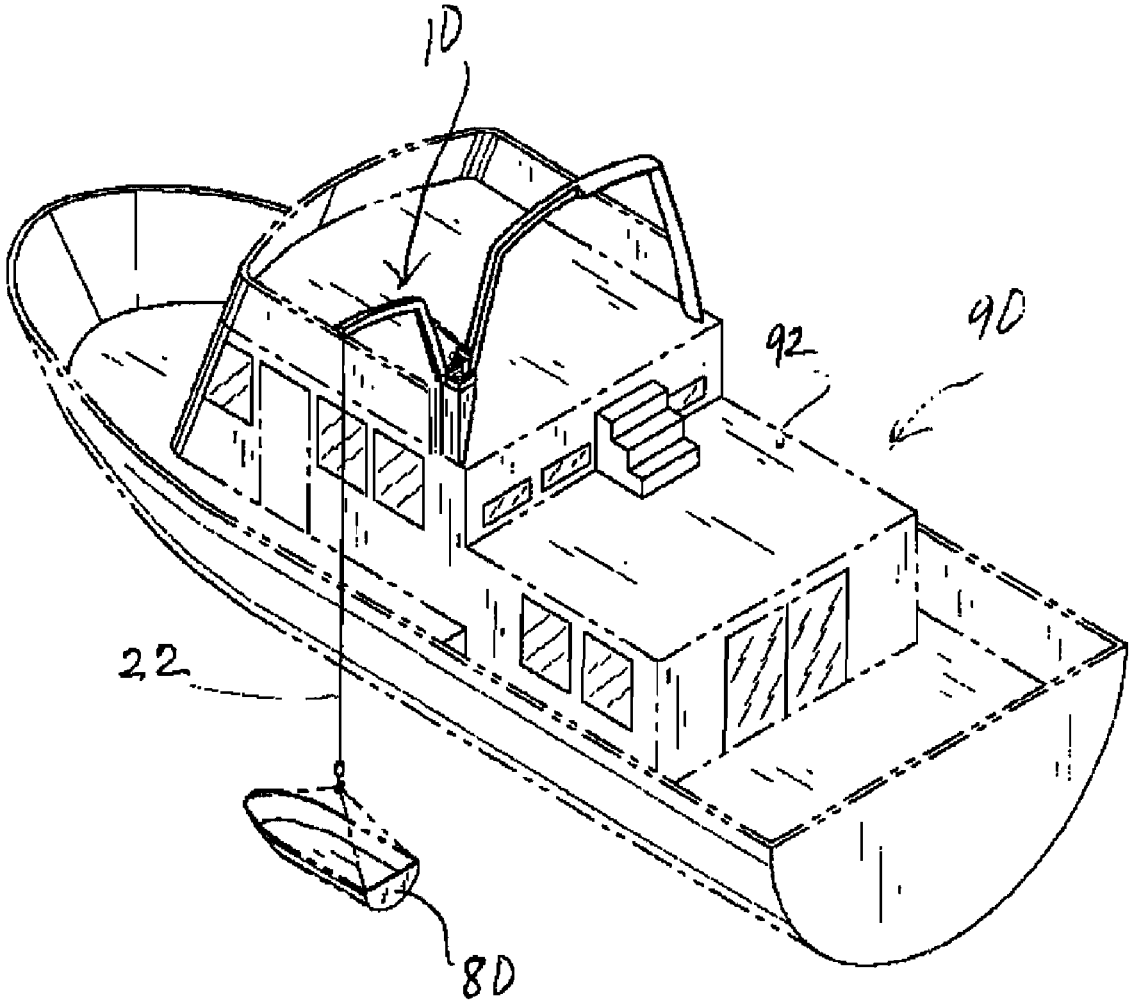
FIG. 3 is a perspective view of the boat fitted with the apparatus in use, the lift arm of the apparatus pivoted to place the dinghy beside the boat.
Figure 4:
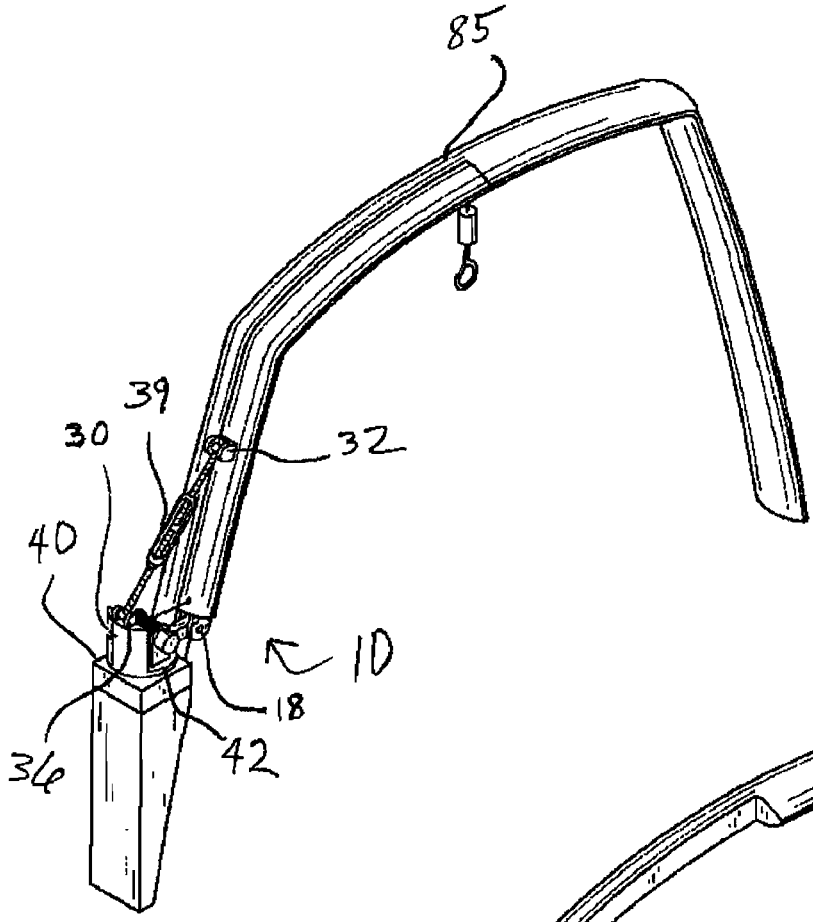
FIG. 4 is a perspective view of the fitted apparatus, the lift arm flush with the boat's arch.
Figure 5:
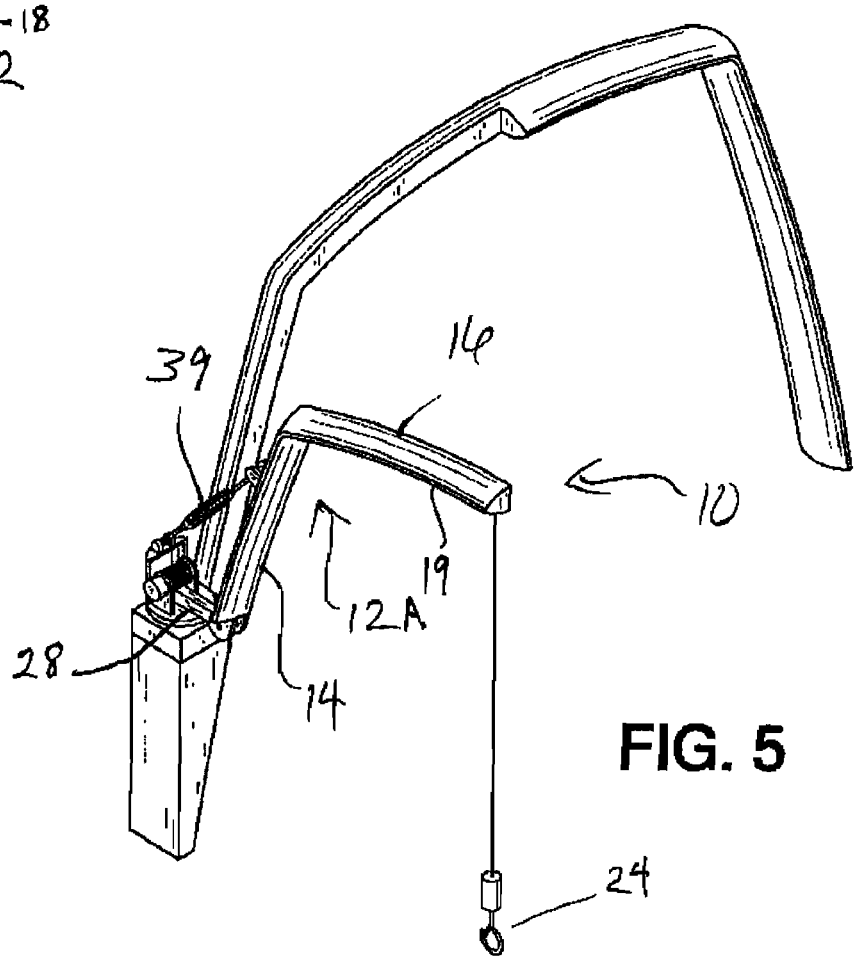
FIG. 5 is a perspective view of FIG. 4, the lift arm pivoted partially outward from the arch.
Figure 6:
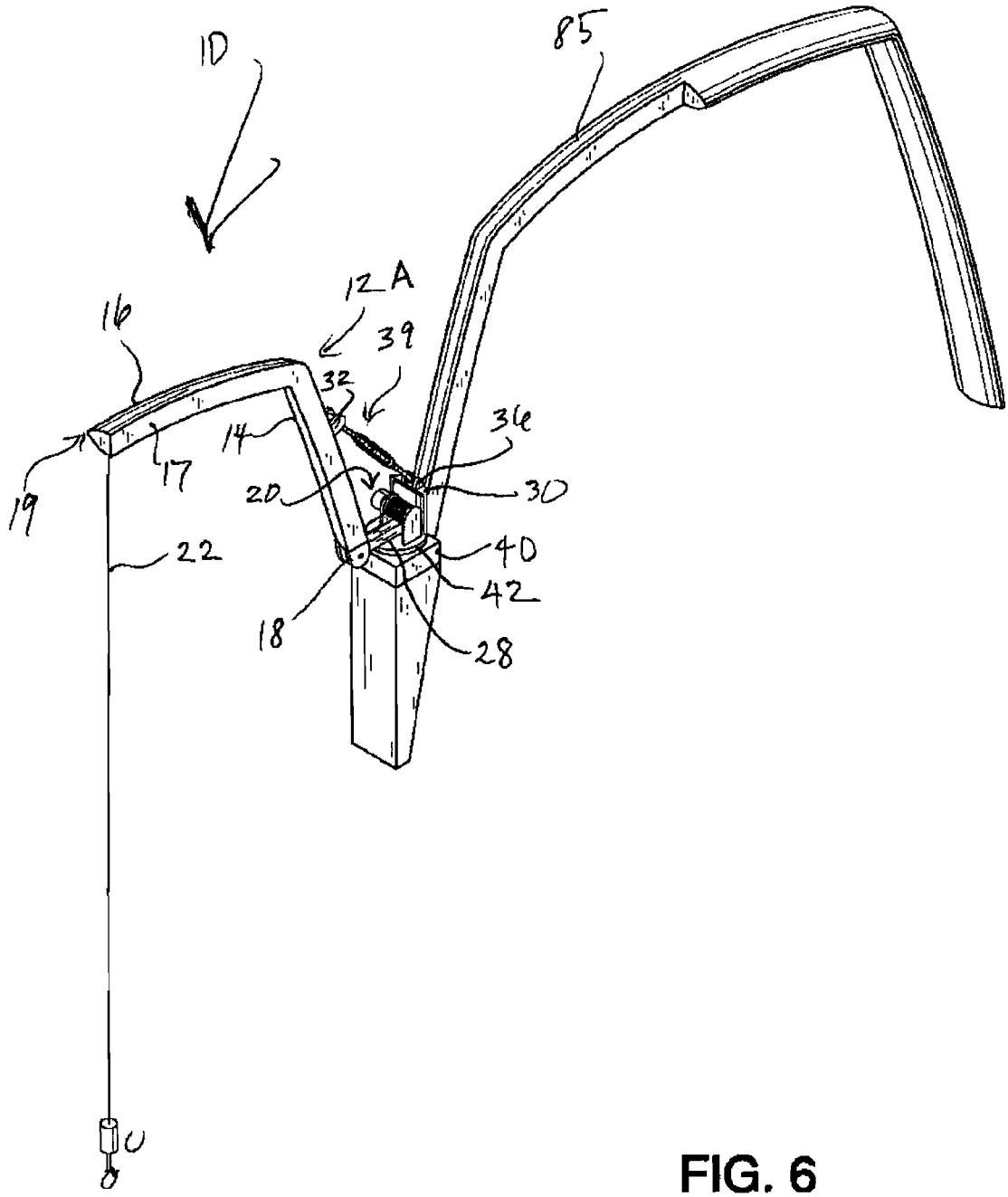
FIG. 6 is a perspective view of FIGS. 4 and 5, the lift arm pivoted a full 180 degrees.
Figure 7:
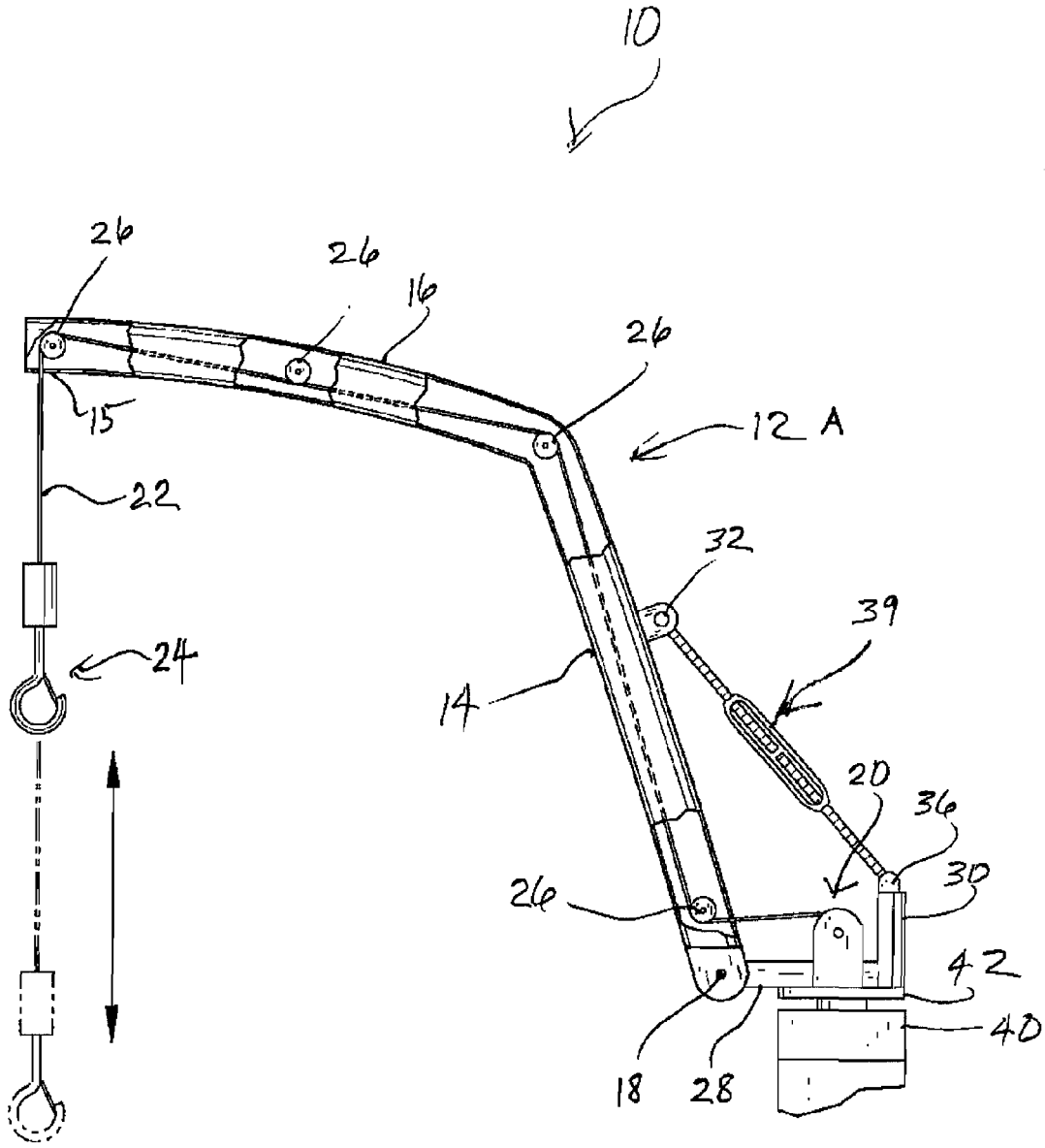
FIG. 7 is a partial cross sectional lateral elevation view of the apparatus.
Figure 8:
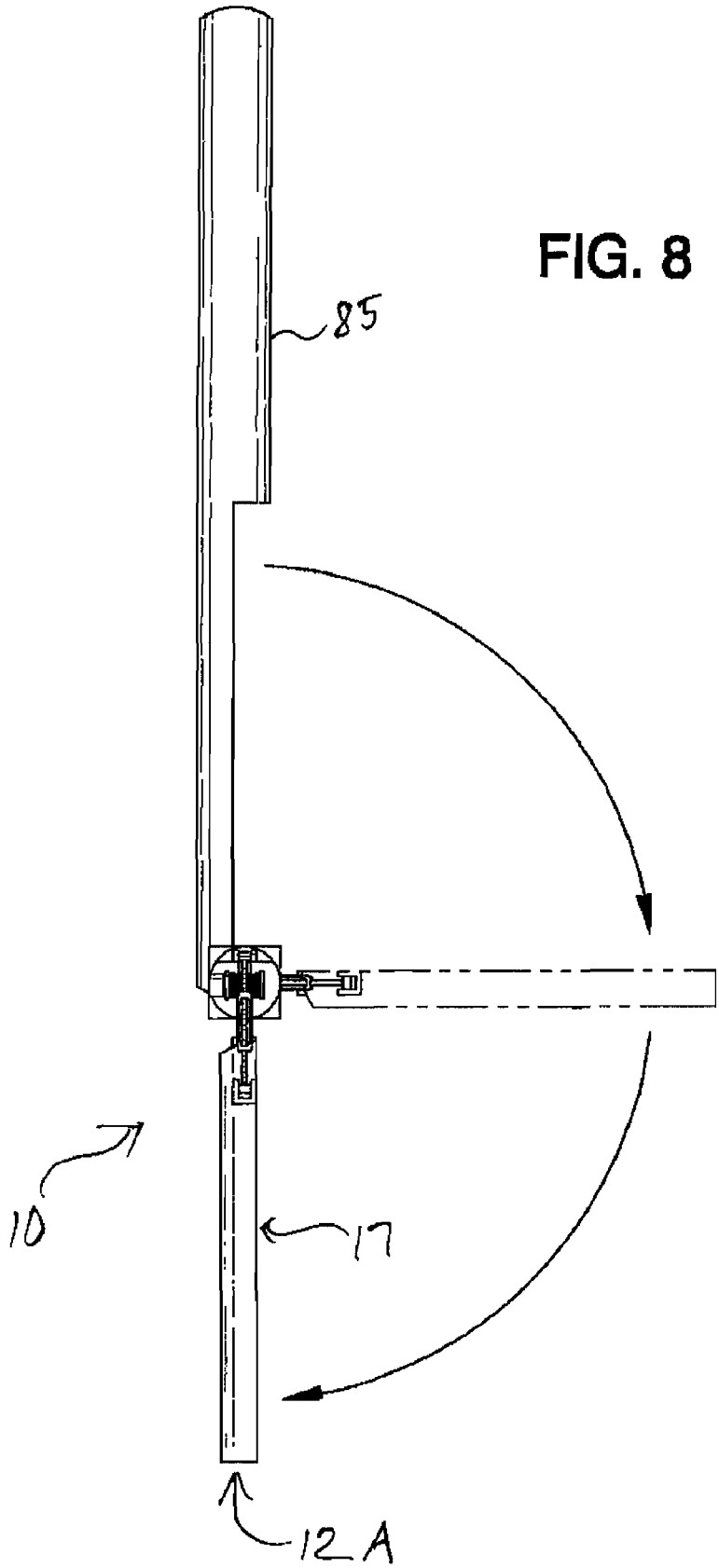
FIG. 8 is a top plan view of the Apparatus of FIGS. 4 and 5.

Referring to FIGS. 1, 2, and 3, the rotating davit apparatus 10 provides an aerodynamic single piece lift arm 12A. The arm 12A is for pivotal fit against the back left side of the existing boat arch 85 of a boat 90. The apparatus 10 mounts adjacent to an existing arch 85 typically affixed to a fly bridge of a boat 90. Typical use of the apparatus entails lifting a dinghy 80 or other personal watercraft to and from the deck 92. The lift arm 12A fits against the arch 85 when not in use and pivots away from the arch 85.

Referring to FIGS. 4-8, the apparatus 10 further comprises a base 40 for attachment to the boat 90. The rotating plate 42 is pivotally attached to the base 40. The rotating plate 42 is capable of at least 180 degrees of rotation. The electric winch 20 is attached to the top of the rotating plate 42. The vertical support 30 is attached adjacent to the outer edge of the top of the rotating plate 42. The lower pivot 36 is affixed to the top of the vertical support 30. The horizontal support 28 is attached to the rotating plate 42 and the vertical support 30, for strength. The horizontal support 28 is extended from the vertical support 30 across the rotating plate 42 and beyond the side of the plate 42 opposite the vertical support 30. The hollow aerodynamic one-piece lift arm 12A is comprised of the riser 14 and the transverse 16. The riser 14 and the transverse 16 are, in appearance, seamlessly combined. The lift arm 12A is coincidental with the shape of the boat arch 85 such that the arch 85 appears to be unaltered to the untrained eye when the lift arm 12A is positioned against the arch 85. The lift arm 12 is attached to the horizontal support 28 via an arm pivot 18. The lift arm 12A further comprises the upper pivot 32 affixed to the riser 14. The lift arm 12A has a face 17 for selective fit against the boat arch 85. The taper 19 is on the side of the lift arm 12A opposite the face 17. The plurality of pulleys 26 is disposed within the lift arm 12A. The orifice 15 is proximal to the end of the transverse 16 of the lift arm 12A. The cable 22 is attached to the electric winch 20 and is passed through the orifice 15. The attachment device on an end of the cable 22 may be a hook 24 or other such known attachment. The adjustable link 39 connects the upper pivot 32 of the riser 14 to the lower pivot 36 of the vertical support 30. The illustrated link 39 is a turnbuckle. The adjustable link 39 provides for a fine-tuned fit against the arch 85.

Figure 9:
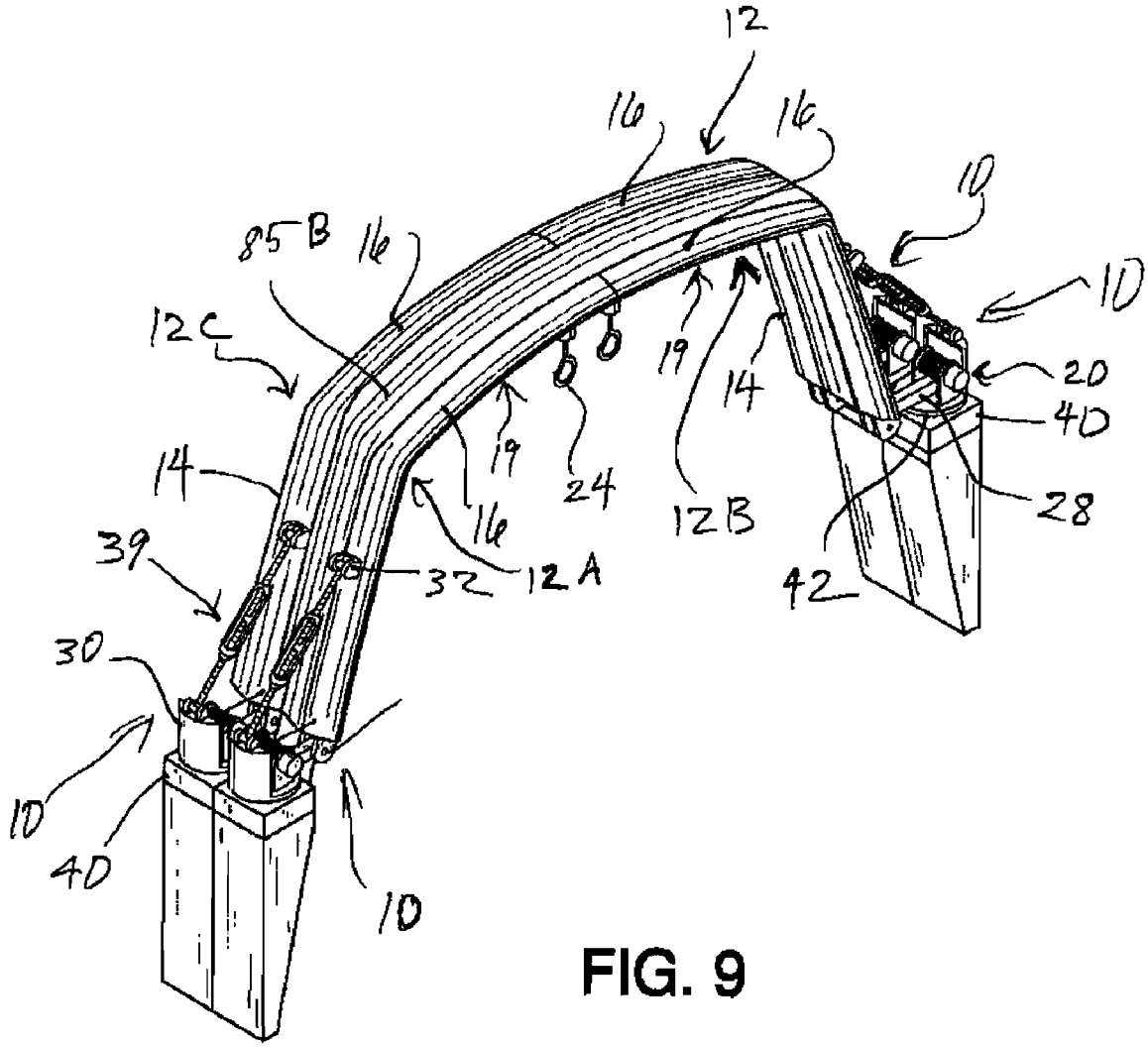
FIG. 9 is a perspective view of a plurality of the apparatuses fitted to an arch, each apparatus rotated into a position flush with the arch.
Figure 10:
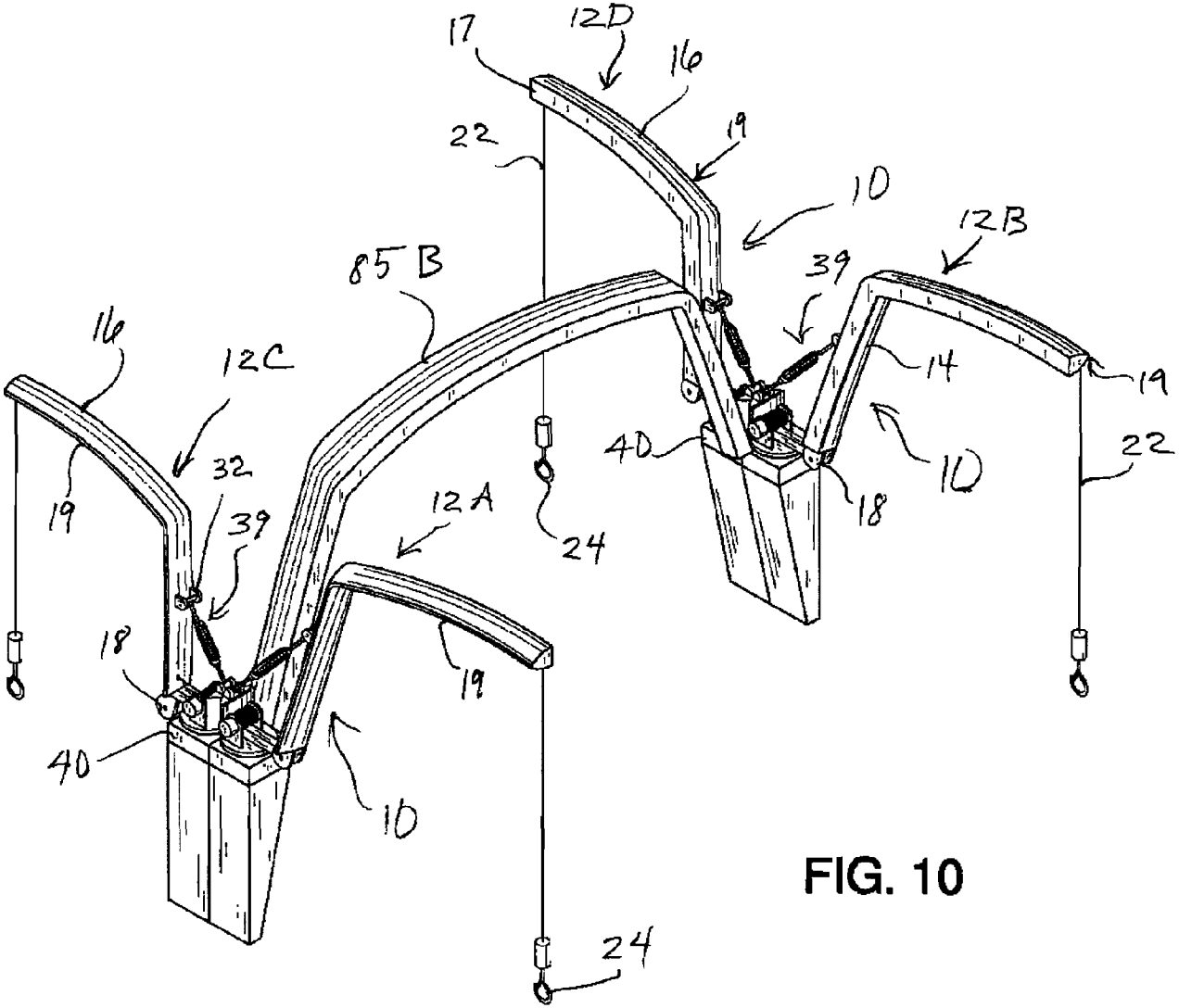
FIG. 10 is a perspective view of the apparatus of FIG. 9, each pivoted partially outward from the arch.
Figure 11:
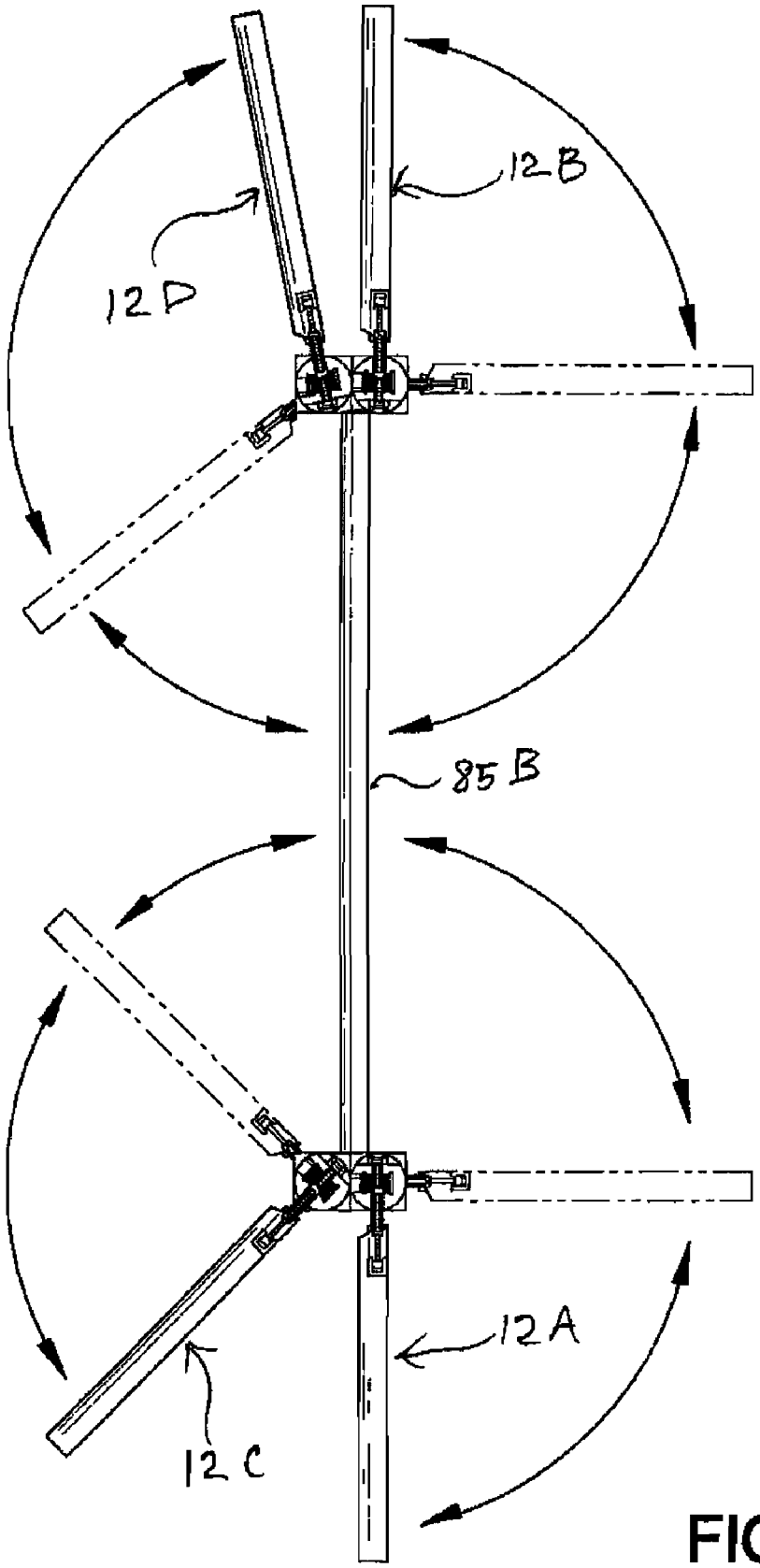
FIG. 11 is a top plan view of the pivotal capabilities of the apparatuses of FIG. 9.

Referring to FIGS. 9, 10, and 11, the plurality of apparatuses 10 is provided in attachment adjacent to the boat arch 85B. From one to four of the apparatuses 10 can be attached for use with a single arch 85B. Each apparatus 10 is provided with a lift arm 12A, 12B, 12C, or 12D which has a face selectively pivoted against the arch 85B. The two apparatus 10 lift arms 12C and 12D are pivotally positioned in the front of the arch 85B. Lift arm 12C is for pivotal fit against the left front of the arch 85B. Lift arm 12D is for pivotal fit against the right front of the arch 85B. The two lift arms 12A and 12B are selectively and pivotally positioned at the rear of the arch 85B. Lift arm 12A is pivotally fitted against the left rear of the arch 85B. Lift arm 12B is pivotally positioned against the right rear of the arch 85B. Lift arms 12A, 12B, 12C, and 12D can be interchanged on each apparatus 10 at the arm pivot 18.

The apparatus 10 is provided for fit to an existing arch 85, which is modified. The apparatus 10 is also provided with a modified arch 85B included. The apparatus 10 provides for proper aerodynamics, whether fitted in singular or multiple apparatus 10 use.

With respect to the above description then, it is to be realized that the optimum dimensional relationships for the parts of the rotating davit apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the rotating davit apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the rotating davit apparatus may be used.

Therefore, the foregoing is considered as illustrative only of the principles of the rotating davit apparatus. Further, since numerous modifications and changes will readily occur to those skilled in the art, it is not desired to limit the rotating davit apparatus to the exact construction and operation shown and described, and accordingly, all suitable modifications and equivalents may be resorted to, falling within the scope of the rotating davit apparatus.

What is claimed is:

1. A rotating davit apparatus having a hollow single piece lifting arm, the arm for pivotal fit against an existing boat arch, the davit comprising:

a base for attachment to a boat;

a rotating plate pivotally attached to the base;

a winch attached to a top of the rotating plate;

a hollow aerodynamic one-piece lift arm, the lift arm comprised of a riser and a transverse, the lift arm coincidental with the shape of the boat arch, the lift arm attached to the rotating plate;

a plurality of pulleys affixed to the lifting arm;

a cable attached to the winch and passed through the pulleys;

an attachment device on an end of the cable;

a connection between the riser and the rotating plate, wherein the connection between the riser and the rotating plate further comprises:

a vertical support attached adjacent to an outer edge of the top of the rotating plate;

a lower pivot affixed to a top of the vertical support;

an upper pivot affixed to the riser;

a link connecting the lower pivot to the upper pivot.

2. The apparatus according to claim 1 wherein the link further comprises adjustability.

3. The apparatus according to claim 1 wherein the rotating plate is capable of at least 180 degrees of rotation.

4. The apparatus according to claim 1 wherein the rotating plate is capable of at least 180 degrees of rotation.

5. The apparatus according to claim 2 wherein the rotating plate is capable of at least 180 degrees of rotation.

6. The apparatus according to claim 1 wherein the attachment of the lift arm to the rotating plate further comprises a horizontal support attached to the rotating plate, the horizontal support extended from the vertical support across the rotating plate and beyond a side of the plate opposite the vertical support.

7. The apparatus according to claim 2 wherein the attachment of the lift arm to the rotating plate further comprises a horizontal support attached to the rotating plate, the horizontal support extended from the vertical support across the rotating plate and beyond a side of the plate opposite the vertical support.

8. The apparatus according to claim 3 wherein the attachment of the lift arm to the rotating plate further comprises a horizontal support attached to the rotating plate, the horizontal support extended from the vertical support across the rotating plate and beyond a side of the plate opposite the vertical support.

9. The apparatus according to claim 4 wherein the attachment of the lift arm to the rotating plate further comprises a horizontal support attached to the rotating plate, the horizontal support extended from the vertical support across the rotating plate and beyond a side of the plate opposite the vertical support.

10. The apparatus according to claim 5 wherein the attachment of the lift arm to the rotating plate further comprises a horizontal support attached to the rotating plate, the horizontal support extended from the vertical support across the rotating plate and beyond a side of the plate opposite the vertical support.

11. A rotating davit apparatus having a hollow single piece lifting arm, the arm for pivotal fit against an existing boat arch, the davit comprising:

a base for attachment to a boat;

a rotating plate pivotally attached to the base;

a winch attached to a top of the rotating plate;

a vertical support attached adjacent to an outer edge of the top of the rotating plate;

a lower pivot affixed to a top of the vertical support;

a horizontal support attached to the rotating plate, the horizontal support extended from the vertical support across the rotating plate and beyond a side of the plate opposite the vertical support;

a hollow aerodynamic one-piece lift arm, the lift arm comprised of a riser and a transverse; the lift arm coincidental with the shape of the boat arch, the lift arm attached to the horizontal support via an arm pivot; the lift arm further comprising:

an upper pivot affixed to the riser;

a face for selective fit against the boat arch;

a taper on a side of the lift arm opposite the face;

a plurality of pulleys within the lift arm;

an orifice proximal to an end of the transverse of the lift arm;

a cable attached to the winch and passed through the orifice of the lift arm;

an attachment device on an end of the cable;

a link connecting the upper pivot of the riser to the lower pivot of the vertical support.

12. The apparatus according to claim 11 wherein the rotating plate is capable of at least 180 degrees of rotation.

13. The apparatus according to claim 11 wherein the link connecting the upper pivot of the riser to the lower pivot of the vertical support is adjustable in length.

14. The apparatus according to claim 11 wherein the link connecting the upper pivot of the riser to the lower pivot of the vertical support is adjustable in length.

15. A plurality of rotating davit apparatuses, each apparatus having a hollow single piece lifting arm, the arm for pivotal fit against an existing boat arch, each davit comprising:

a base for attachment to a boat;

a rotating plate pivotally attached to the base;

a winch attached to a top of the rotating plate;

a vertical support attached adjacent to an outer edge of the top of the rotating plate;

a lower pivot affixed to a top of the vertical support;

a horizontal support attached to the rotating plate, the horizontal support extended from the vertical support across the rotating plate and beyond a side of the plate opposite the vertical support;

a hollow aerodynamic one-piece lift arm, the lift arm comprised of a riser and a transverse; the lift arm coincidental with the shape of the boat arch, the lift arm attached to the horizontal support via an arm pivot; the lift arm further comprising:

an upper pivot affixed to the riser;

a face for selective fit against the boat arch;

a taper on a side of the lift arm opposite the face;

a plurality of pulleys within the lift arm;

an orifice proximal to an end of the transverse of the lift arm;

a cable attached to the winch and passed through the pulleys and the orifice of the lift arm;

an attachment device on an end of the cable;

a link connecting the upper pivot of the riser to the lower pivot of the vertical support.

16. The apparatus according to claim 15 wherein the link connecting the upper pivot of the riser to the lower pivot of the vertical support is adjustable.

* * * * *